US006622631B2

(12) United States Patent
Cho

(10) Patent No.: US 6,622,631 B2
(45) Date of Patent: Sep. 23, 2003

(54) SLACKENING TYPE BLASTING METHOD

(76) Inventor: Yong-So Cho, A-205 Hyundai Yonlip, #513-1 Dunchon-dong, Gangdong-gu, Seoul (KR)

( * ) Notice: Subject to any disclaimer, the term of this patent is extended or adjusted under 35 U.S.C. 154(b) by 0 days.

(21) Appl. No.: 09/839,132

(22) Filed: Apr. 23, 2001

(65) Prior Publication Data

US 2002/0005135 A1 Jan. 17, 2002

(30) Foreign Application Priority Data

May 18, 2000 (KR) ..... 00-26596

(51) Int. Cl.[7] ..... F42D 5/05
(52) U.S. Cl. ..... 102/303; 102/302
(58) Field of Search ..... 102/302, 303

(56) References Cited

U.S. PATENT DOCUMENTS 2,806,426 A * 9/1957 Klokseth ..... 102/303
2,926,605 A * 3/1960 Hammel, Jr. et al. ..... 102/303
3,331,322 A * 7/1967 Belanger ..... 102/303
3,793,953 A * 2/1974 Lewis ..... 102/303
3,943,853 A * 3/1976 Robertson et al. ..... 102/303
4,315,463 A * 2/1982 Arcand ..... 102/303
5,194,689 A * 3/1993 Cummins ..... 102/302

FOREIGN PATENT DOCUMENTS

CA 1019201 * 10/1977 ..... 102/303

* cited by examiner

*Primary Examiner*—Peter A. Nelson
(74) *Attorney, Agent, or Firm*—Birch, Stewart, Kolasch & Birch, LLP

(57) ABSTRACT

A blasting mat assembly comprising a steel plate member having thickness capable of bearing a blasting pressure of explosives inputted to blasting hole; an elastic member which is fixedly attached along a bottom edge of the steel plate member for isolating blasting noise, blasting gas and flying material. Explosives inputted into each blasting hole of blasting region are discharged; and a weight reinforcing member which is welded to a top surface of the steel plate member in a structure of a grid frame made of steel beams.

12 Claims, 4 Drawing Sheets

SLACKENING TYPE BLASTING METHOD

BACKGROUND OF THE INVENTION

The present invention relates to a slackening type blasting method for excluding by excavating part of a sloping surface formed by a base rock layer at one side, or both sides, of a road upon establishing or expanding of the road, or for excavating a part of a middle portion of a base rock layer In general, there is a need to cut out a sloped surface made of base rock layer in road construction work for establishing or expanding a remote hill road, or a seashore road along mountain topography. In this case, excavating work of a base rock slope is executed by utilizing heavy-duty equipment such as a large type braker or excavator. In order to prevent accident or damage of passing vehicles during operation, a problem occurs in which mechanical excavating work utilizing the heavy duty equipment is decreased in its excavating efficiency, and a working term becomes longer when the sloped base rock layer is a hard base rock layer which is high in base rock strength. In such a case, cutting out the sloped rock surface is executed by a blasting method utilizing explosives.

In accordance with the blasting method of prior art, a so called mobile type blasting method has been used in which explosives filled in a number of blasting holes pierced into a base rock layer are detonated so that the base rock layer is completely released from the mother rock via its blasting pressure.

However, since the mobile type blasting method of the prior art increases the blasting pressure by using large quantities of explosives in order to completely release the base rock layer of a part desired to be cut out from the mother rock, there has been a problem of blasting noise, and that a part of base rock broken upon blasting flies far away from the blasting site to a remote place. But also a blasting vibration coming from the blasting pressure is transmitted far away. Consequently, the blasting has been done by laying a mat made of rubber material or a straw bag etc. on the base rock surface so that the blasting noise is decreased and the broken base rock layer particles cannot be flied. But, since the rubber mat and the straw bag covered on the base rock layer fly away together with broken base rock particles by the blasting pressure, it is hard to expect an effect capable of largely decreasing the blasting noise and vibration. And in a case when human dwelling houses and the like are located within 100 m near a construction working site, there is a problem that an application of a blasting method is difficult to safely implement and a passing of neighboring roads should be isolated.

A base rock layer made of hard rock has to be cut out with a predetermined width at a construction site for establishing or expanding the mountain road or seashore road. Dwelling houses and livestock facilities scattered within 100 m from that construction working site and public establishments due to the exploding noise and the blasting vibration and the like produced upon blasting the base rock layer, not only the dwelling residences are exposed to noise but also flying stones are thrown into residences. Also, the building is shaken due to the blasting vibration or a ground-sinking phenomenon occurs. Furthermore, a problem is arisen which gives vast casualties to various animals bred in livestock facilities. Still further there is a worry about producing casualties which induces an accident due to influence of exploding sound.

SUMMARY OF THE INVENTION

Accordingly, it is a primary object of the present invention to provide an improved blasting method which provides improved and sound abatement to surrounding areas.

It is another object of the present invention to provide a method using an improved blasting mat for achieving the improved safety and sound abatement features of the improved blasting method.

These and other objects are fulfilled by providing a slackening type blasting method for separating rock layers in a blasting region from surrounding mother rock by generating a crack formation, comprising the steps of, dividing the blasting region into a plurality of sub-regions in a top surface of the base rock; drilling each sub-region with a plurality of vertically oriented blasting holes with predetermined spacings therebetween; inserting explosives into each blasting hole; connecting the explosive with a lead wire electrically connected to a detonator; covering the blasting region with a blasting mat including, a metal plate having a bottom surface for covering a blasting region, said plate having a thickness capable of containing blasting forces within said region; an elastic barrier connected to the periphery of the bottom surface for dampening blast noise and containing flying debris generated by the blast; and a frame having a substantial weight resting on a top surface of the metal plate, said frame having metal beams in a grid configuration overlying the top surface of the metal plate; and operating the detonator to successively detonate explosives in the blasting holes in accordance with a predetermined order to thereby generate said crack formation.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF PREFERRED EMBODIMENT

Figure 1:
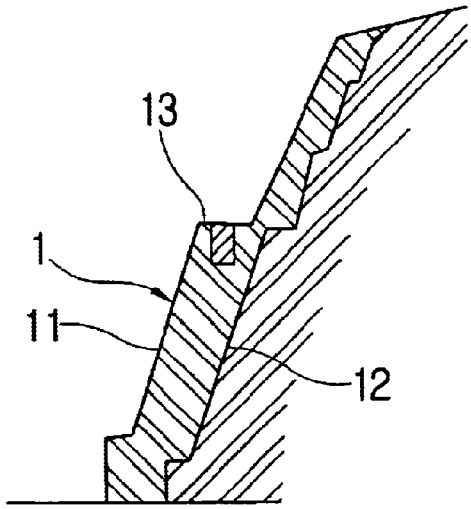
FIG. 1 is a side view of one embodiment for explaining the present invention.

Explaining an embodiment of the present invention in more detail with reference to the accompanying drawings, FIG. 1 is a side view of one embodiment for explaining the present invention.

A reference numeral 1 depicts a base rock layer formed at one side or both sides of road when establishing or expanding a mountain road or seashore road, and reference numeral 2 denotes a blasting mat according to the present invention.

The blasting mat 2 is constructed such that a steel plate member 21 having a thickness (more than 3 mm) and a lower surface capable of sufficiently bearing the blasting pressure of explosives is provided over a blasting hole. An elastic member 22 is fixedly attached to an edge portion of the steel plate member 21 thereby diminishing blasting noise and flying stones. A weight reinforcing member 23 made of a steel frame such as from I-type beams or H-type beams rests on a top surface of the steel plate member 21 and is welded to edge portions in a grid shape. A carrying wire 24 capable of lifting the blasting mat 2 is fixedly attached at a top surface of the steel plate member 21, or else by a hooking member to its weight center portion, so that the blasting mat 2 can be moved and carried by utilizing heavy duty equipment 3, such as a large type braker or excavator.

The elastic member 22 attached to bottom edge portion of the blasting mat 2 is very elastic and easy to attach by bolts and the like. It is preferable to use waste tires 22*a* which sufficiently bears the blasting pressure together with vibrations of the steel plate member upon blasting of explosive and simultaneously exterior discharging of blasting noise, blasting gas and flying stones. A close adherence to bumpy ground surfaces is helpful so that all directions about the steel plate member 21 are protected.

The blasting method of the present invention, which blasts and cuts out the portion between free surface 11 and cut-out surface 12 of the base rock layer 1 from a top layer to a bottom layer stepwise by using the blasting mat 2 as described above, operates as follows.

A blasting region 14 is formed on a horizontal top surface between free surface 11 and cut-out surface 12 of the base rock layer by equally dividing the surface into predetermined regions. Then a number of blasting holes 15 are pierced at predetermined distance intervals in each blasting region 14, and the blasting holes 15 are formed not only in the blasting regions 14 but also in neighboring blasting regions 14, the holes are pierced so as to maintain a predetermined distance therebetween among the blasting holes 15.

Each of the blasting holes 15 formed in the blasting regions 14 are pierced by previously establishing the piercing depth to reflect the dislocation structure of the base rock layer 1.

Figure 3:
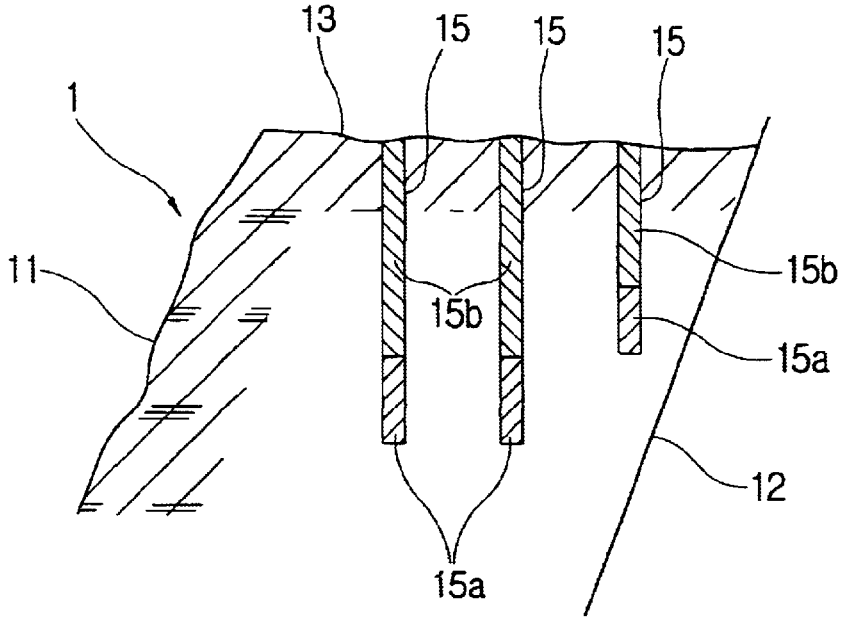
FIG. 3 and FIG. 4 are cross sectional views showing a pierced hole depth of blasting holes of the present invention.
Figure 4:
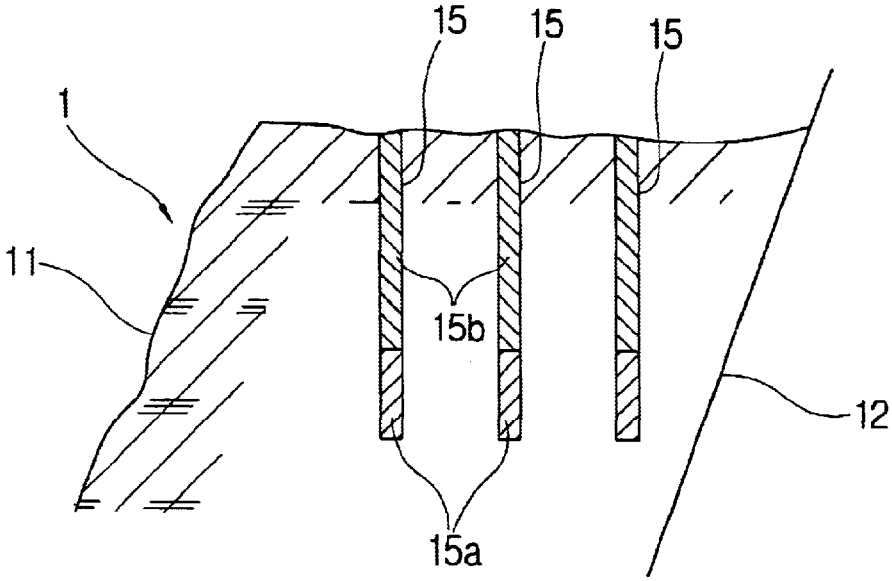
Figure 5:
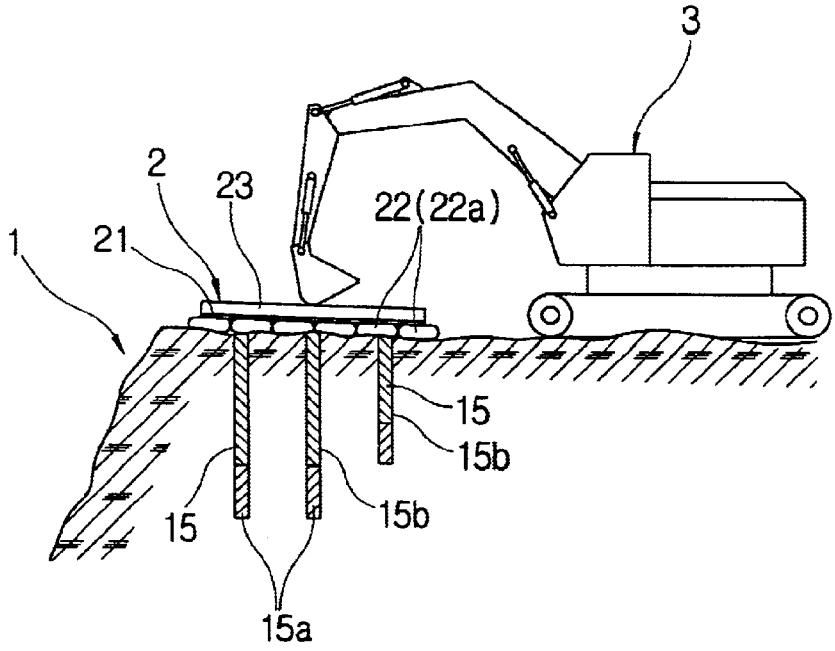
FIG. 5 is a view of a blast executing state of the present invention.
Figure 6:
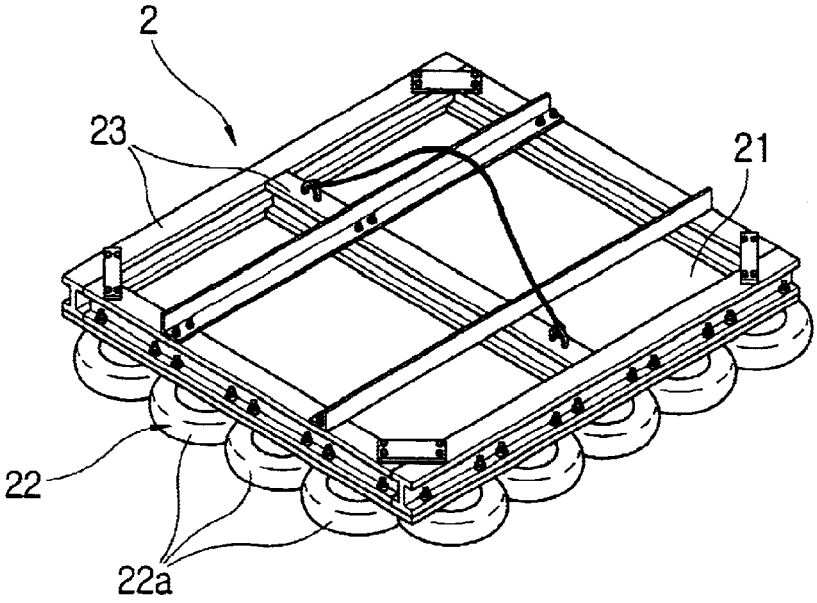
FIG. 6 is a perspective view for depicting a blasting mat structure of the present invention.
Figure 7:
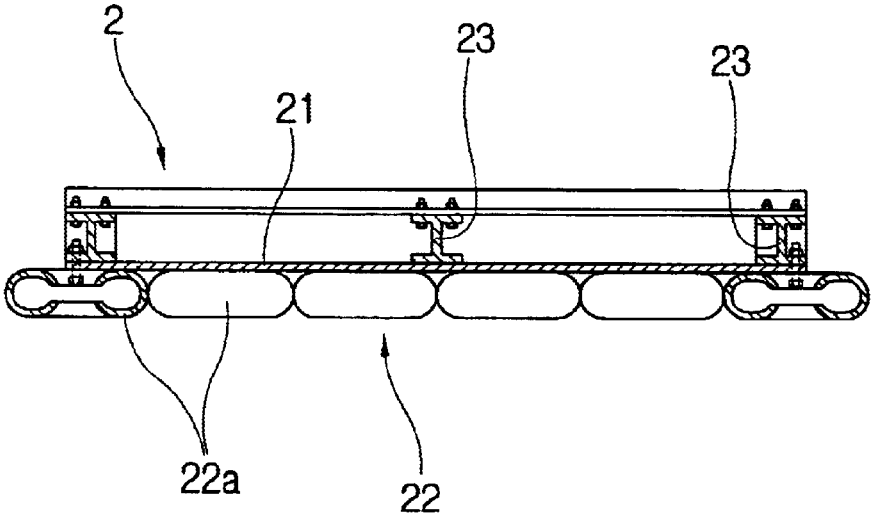
FIG. 7 is a cross sectional view of blasting mat of the present invention.
Figure 8:
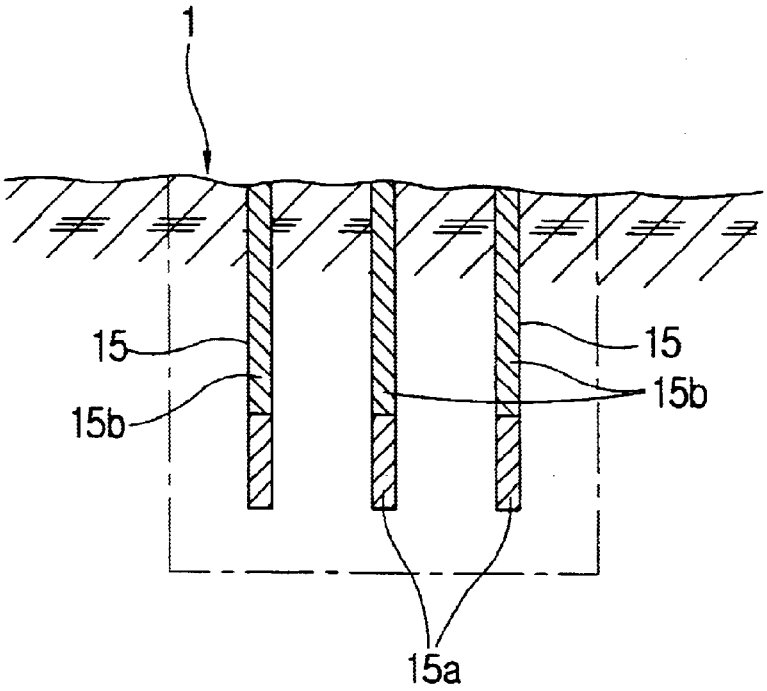
FIG. 8 is a view of an embodiment applying the present invention to a surface base rock layer.

That is, as in FIG. 3, the blasting hole 15 located at adjacent to free surface 11, and the blasting hole 15 located at the middle, are deeply pierced while the blasting hole next to the cut out surface 12 is pierced a little shallower whereby the blasting method can be executed, or as shown in FIG. 4, the blasting method can be executed by equally piercing the depth of all blasting holes.

An explosive 15*a* having a blasting power capable of slackening the cutting out portion up to the depth desired, is filled in the blasting holes 15 formed in each of the blasting regions 14. Then a blasting lead wire is connected, and a quantity of explosive filled to the blasting hole 15 is filled only up to a degree (less than 0.4 kg/m2) which is relatively weak so that only a crack of the base rock layer 1 is slackened from the mother rock, i.e., cut out surface 12. Said blasting lead wire is provided such that the explosives 15*a* filled in the blasting holes 15 are located at each blasting region 14 can be subsequently blasted at time intervals of extremely short time periods (about 0.02 second to 0.05 second). Sand 15*b* is filled to the blasting hole 15 after connecting the blasting lead wire to the explosives 15*a*.

As described above, after the explosive 15*a* and the sand 15*b* are filled into the blasting hole 15 of each blasting region 14, a blasting mother wire for blasting the explosive 15*a* of each blasting hole 15 is connected to the blasting means, and then the blasting mat 2 is lifted by heavy duty equipment 3, whereby the top surface of the blasting region 14 to be blasted is covered. Since the area of the blasting mat 2 is bigger than the blasting region 14, and the waste tires 22*a* of elastic member 22 are closely adhered on the top surface of the blasting region 14 outside of the blasting holes 15, and are pressed by the weight of reinforcing member 23, even if the top surface of the blasting region 14, i.e., the horizontal top surface 13 of base rock layer 1 is an uneven and irregularly bumpy surface, the waste tires 22*a* of the elastic member 22 are closely adhered on top surface of bumpy blasting region 14. The weight reinforcing member 23 is strongly pressed by a boom bar of the heavy-duty equipment 3, said waste tires 22*a* are pressed and adhered on the top of the blasting region 14 by more strong elasticity. At the same time, even among mutually neighboring waste tires 22*a*, the blasting mat 2 maintains a firm posture to contain strong blasting pressure and vibration.

As described above, during blasting the blasting mat 2 provided over the blasting region 14 is pressed by the heavy duty equipment 3, and the explosives 15*a* filled into each blasting hole 15 are successively blasted. At this moment, the successive blasting of explosives 15*a* produces only a crack so that the base rock layer 1 of the blasting region 14 is completely divided from the cutting out surface 12, and the sand 15*b* which has been filled to the blasting hole 15 upon blasting of explosive 15*a* and blasting gas and blasting noise are moved upward of the blasting hole 15. The steel plate member 21 of the blasting mat 2 which covers the top surface of the blasting region 14 is a steel plate of a thickness capable of sufficiently bearing the blasting pressure, and since the waste tires 22*a* of elastic member 22 are not only closely adhered on top of the blasting region 14, but are closely adhered each other, the blasting pressure produced upon blasting of explosives 15*a* and the flying sand accompanying it and the blasting gas, are not flown or leaked through the exterior of the blasting mat 2. Since the waste tires 22*a* are elastic each absorb the blasting noise and vibration. The blasting noise and vibration transferred around blasting site can be significantly decreased, and the blasting pressure of explosives 15*a* are of a degree capable to cut out with a crack base rock layer 1 from mother rock. The blasting vibration is transferred only around of the blasting region 14, but it is not transferred outwardly.

Thus, when the blasting work of the blasting region 14 of one place is finished, the blasting mat 2 is moved by heavy-duty equipment 3 to the next blasting region 14 and covered. The blasting work is progressed in a stepwise manner, and after the blasting works of all blasting region 14 of the base rock layer 1 are finished, the cutting out work of the base rock layer 1 is completed via means excavating the base rock layer 1 of the blasting region 14 by heavy duty equipment such as a braker, ripper and the like.

EXAMPLE

A blasting of a base rock layer was tested as follows by applying the blasting method in accordance with the present invention, and measured results such as vibration and noise according to it are shown in Table 1.

In accordance with the above test results, the maximum value of noise at a facility distanced by 50m from the blast working site was measured as 67.6 dB, and it did not exceed 60 dB. However, noise lower than 90 dB causes humans and animals to start to feel pain from the noise. Particularly, the noise at 10 m neighboring the working site was no more than 92.6 dB. In maximum value, and was lower than 100 dB equivalent to a vehicle running on highway. The vibration was also detected as 0.1 cm/s at 50 m. Therefore, it has shown that an influence giving to livestock was almost none in a case when a cattle shed or the like were distanced apart more than 100 m from the working site.

Blasting Condition

Figure 2:
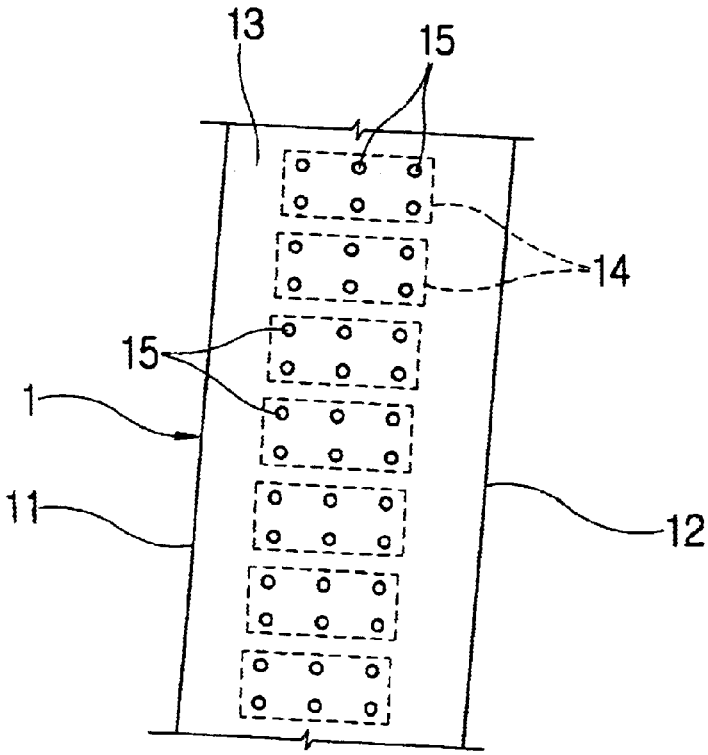
FIG. 2 is a plan view for showing a state of a blasting hole arrangement of the present invention.

Blast Working Object:

Hard rock layer (a working site of condition as FIG. 2 and FIG. 3) cutting slope width 25 m, height 15*Blasting hole piercing diameter and equipment:

ϕ 51 mm, Crawler drill

*Used Explosive:

ϕ 32 mm New MITE 5500 (product of Hankook Gun Powder Co. Ltd.)

*Used Detonator:

MS electric detonator (product of Hankook Gun Powder Co. Ltd.)

*Blasting Hole Piercing Depth:

Inner side hole 2.0 m, free surface side 3.0 m

*Each Blasting Hole Piercing Distance: 0.9 m

*Blasting Hole Piercing Number: 6 ea (2 Row Arrangement)

*Blasting Mat:

Steel plate thickness 3.5 mm, width 3.0 m, length 2.3 m, weight 2.2 ton

*Top of the Blasting Mat is Pressed by Bucket of Fork Crane.

TABLE 1

| vibraton, noise, measuring instrument kind | blasting num-bers | dist-ance (m) | filling quantity per blasting (kg) | measuring value particle speed (cm/sec) | frequency (Hz) | acceler-ration (g) | PVS (cm/sec) | noise dB(A) dB(L) storm presure | measuring location |
|---|---|---|---|---|---|---|---|---|---|
| DS677 (2506) (german company product) | 1 | 50 | 0.75 | T: 0.038<br>V: 0.097<br>L: 0.070 | >100<br>51<br>73 | 0.0298<br>0.0331<br>0.0414 | 0.110 | 67.6(A) | 50 m place |
| | 2 | 50 | 0.75 | T: 0.041<br>V: 0.046<br>L: 0.080 | 39<br>47<br>32 | 0.0215<br>0.0215<br>0.0331 | 0.064 | 62.0(A) | |
| | 3 | 51 | 0.75 | T: 0.079<br>V: 0.048<br>L: 0.052 | 39<br>73<br>34 | 0.0199<br>0.0255<br>0.0182 | 0.010 | 64.6(A) | |
| | 4 | 52 | 0.5 | T: 0.051<br>V: 0.030<br>L: 0.048 | 37<br>47<br>34 | 0.0149<br>0.0182<br>0.0149 | 0.064 | 65.8(A) | |
| | 5 | 53 | 0.75 | T: 0.083<br>V: 0.091<br>L: 0.083 | 27<br>51<br>32 | 0.0199<br>0.0348<br>0.0199 | 0.100 | 64.0(A) | |
| | 6 | 54 | 0.5 | T: 0.054<br>V: 0.045<br>L: 0.040 | 37<br>51<br>39 | 0.0149<br>0.0149<br>0.0116 | 0.057 | 65.0(A) | |
| BMIII (BA5687) german company product) | 1 | 30 | 0.75 | T: 0.349<br>V: 0.351<br>L: 0.394 | 54<br>85<br>45 | 0.133<br>0.196<br>0.116 | 0.528 | 74.4(A) | 30 m place |
| | 2 | 31 | 0.75 | T: 0.232<br>V: 0.322<br>L: 0.289 | 51<br>54<br>47 | 0.0928<br>0.166<br>0.109 | 0.375 | 74.49A) | |
| | 3 | 32 | 0.75 | T: 0.195<br>V: 0.230<br>L: 0.362 | 60<br>43<br>45 | 0.0829<br>0.113<br>0.106 | 0.398 | 73.1(A) | |
| | 4 | 33 | 0.5 | T: 0.140<br>V: 0.162<br>L: 0.254 | 57<br>39<br>43 | 0.0663<br>0.0563<br>0.0696 | 0.296 | 70.1(A) | |
| | 5 | 34 | 0.75 | T: 0.325<br>V: 0.560<br>L: 0.378 | 47<br>43<br>39 | 0.106<br>0.176<br>0.109 | 0.568 | 69.6(A) | |
| | 6 | 35 | 0.5 | T: 0.149<br>V: 0.227<br>L: 0.257 | 57<br>60<br>37 | 0.0729<br>0.0795<br>0.0696 | 0.269 | 68.0(A) | |
| BMIII (BA5745) (german company product) | 1 | 70 | 0.75 | T: 0.079<br>V: 0.081<br>L: 0.064 | 38<br>51<br>33 | 0.0331<br>0.0255<br>0.0331 | 0.099 | 65.8(A) | 70 m place |
| | 2 | 70 | 0.75 | T: 0.049<br>V: 0.071<br>L: 0.069 | 68<br>60<br>68 | 0.0331<br>0.0265<br>0.0331 | 0.083 | 61.2(A) | |
| | 3 | 2 | 0.75 | Impos-sible to measure | 43<br>54<br>37 | 0.298<br>0.587<br>0.324 | impos-sible to measure | 94.9(A) | 2 m place |
| | 4 | 10 | 0.5 | T: 1.80<br>V: 1.60<br>L: 1.59 | 49<br>73<br>73 | 1.35<br>1.09<br>0.981 | 2.00 | 91.5(A) | 10 m place |
| | 5 | 10 | 0.75 | T: 6.36<br>V: 9.86<br>L: 6.12 | 15.8<br>19.7<br>15.1 | 1.48<br>5.57<br>3.13 | 10.8 | 90.7(A) | |

TABLE 1-continued

| vibraton, noise, measuring instrument kind | blasting num-bers | dist-ance (m) | filling quantity per blasting (kg) | measuring value particle speed (cm/sec) | frequency (Hz) | acceler-ration (g) | PVS (cm/sec) | noise dB(A) dB(L) storm presure | measuring location |
|---|---|---|---|---|---|---|---|---|---|
| | 6 | 10 | 0.5 | T: 2.77 | 79 | 2.68 | 3.46 | 92.6(A) | |
| | | | | V: 2.60 | 64 | 2.01 | | | |
| | | | | L: 2.17 | 79 | 1.75 | | | |

In accordance with the present invention the blasting method using an explosive is executed in order to cut out one part of a free surface of a base rock layer utilizing a mat, including a mat body made of thick steel plate member and waste tire absorbing member covering the work site, so that flying stones, blasting noise, or blasting vibration are remarkably decreased, whereby not only casualty generation due to noise and vibration can be extremely minimized. But also public facilities, such as electric power transmitting towers whereby a part of a free surface of the base rock layer can be slackened from mother rock. Since stones after blasting are isolated, base rock layer cutting work is made to progress without controlling the passing of vehicles on neighboring roads. And, since an operator of a blasting site, and the heavy duty equipment such as a braker, ripper and the like excavating the blasted base rock layer are located at a short distance (about 5–10 m) of the blasting site, the excavating work can be speedily progressed by heavy duty equipment after the blasting work of the blasting region is finished, Consequently, cutting work of the base rock layer can be reduced.

What is claimed is:

1. A slackening type blasting method for separating rock layers in a blasting region from surrounding mother rock by generating a crack formation, comprising the steps of:

a) dividing the blasting region into a plurality of sub-regions in a top surface of the base rock;

b) drilling each sub-region with a plurality of vertically oriented blasting holes with predetermined spacings therebetween;

c) inserting explosives into each blasting hole;

d) connecting the explosive with a lead wire electrically connected to a detonator;

e) covering the blasting region with a blasting mat including, a metal plate having a bottom surface for covering a blasting region, said plate having a thickness capable of containing blasting forces within said region; an elastic barrier connected to the periphery of the bottom surface for dampening blast noise and containing flying debris generated by the blast; and a frame having a substantial weight resting on a top surface of the metal plate, said frame having metal beams in a grid configuration overlying the top surface of the metal plate; and f) operating the detonator to successively detonate explosives in the blasting holes in accordance with a predetermined order to thereby generate said crack formation.

2. The method of claim 1 wherein said metal plate is steel and has a thickness of at least 3 mm.

3. The method of claim 1 wherein the blasting mat is placed on the blasting region by a boom of a construction device, and the boom is maintained on the top surface of the metal plate during blasting.

4. The method of claim 1 including the further step of partially filling said blasting holes with sand on top of said explosives.

5. The method of claim 4 wherein the elastic barrier comprises a plurality of juxtaposed rubber tires.

6. The method of claim 5 wherein axes of the rubber tires are oriented substantially orthogonal to said top and bottom surfaces.

7. The method of claim 6 wherein said beams are steel I-beams or H-beams.

8. The method of claim 4 wherein said beams are steel I-beams or H-beams.

9. The method of claim 1 wherein the elastic barrier comprises a plurality of juxtaposed rubber tires.

10. The method of claim 1 wherein axes of the rubber tires are oriented substantially orthogonal to said top and bottom surfaces.

11. The method of claim 1 wherein said beams are steel I-beams or H-beams.

12. The method of claim 1 wherein said beams are steel I-beams or H-beams.

* * * * *